US009946200B2

(12) United States Patent
Sabo

(10) Patent No.: US 9,946,200 B2
(45) Date of Patent: Apr. 17, 2018

(54) BINARY INK DEVELOPER ASSEMBLY INCLUDING SLOTS HAVING A SLOT ANGLE CORRESPONDING TO A PRESSURE ANGLE

(71) Applicant: Hewlett-Packard Development Company, L.P., Houston, TX (US)

(72) Inventor: David Sabo, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/514,114

(22) PCT Filed: Sep. 30, 2014

(86) PCT No.: PCT/US2014/058415
§ 371 (c)(1),
(2) Date: Mar. 24, 2017

(87) PCT Pub. No.: WO2016/053318
PCT Pub. Date: Apr. 7, 2016

(65) Prior Publication Data
US 2017/0293244 A1 Oct. 12, 2017

(51) Int. Cl.
*G03G 15/095* (2006.01)
*G03G 9/12* (2006.01)

(52) U.S. Cl.
CPC ..... *G03G 15/095* (2013.01); *G03G 9/12* (2013.01)

(58) Field of Classification Search
CPC ..... G03G 15/095; G03G 9/12; G03G 15/10; G03G 2221/1657; G03G 21/1647; G03G 21/1857; G03G 21/186
See application file for complete search history.

(56) References Cited

U.S. PATENT DOCUMENTS

| | | | |
|---|---|---|---|
| 5,640,901 | A | 6/1997 | Kinoshita |
| 6,108,508 | A | 8/2000 | Takeuchi et al. |
| 8,292,424 | B2 | 10/2012 | Miyashita et al. |
| 8,408,123 | B2 | 4/2013 | Novak et al. |
| 2006/0204275 | A1 | 9/2006 | Patton et al. |
| 2007/0102873 | A1 | 5/2007 | Acton et al. |
| 2007/0145678 | A1 | 6/2007 | Terada |
| 2008/0267660 | A1 | 10/2008 | Schneider et al. |
| 2010/0215405 | A1 | 8/2010 | Patton et al. |
| 2011/0280642 | A1 | 11/2011 | Ikeda et al. |
| 2013/0223888 | A1 | 8/2013 | Tanner et al. |
| 2013/0336688 | A1 | 12/2013 | Asakawa et al. |
| 2014/0196623 | A1* | 7/2014 | Lopez ..... B41J 19/147 101/416.1 |
| 2014/0205316 | A1 | 7/2014 | Lee et al. |

* cited by examiner

*Primary Examiner* — Sandra Brase
(74) *Attorney, Agent, or Firm* — HP Inc. Patent Department

(57) ABSTRACT

A binary ink developer assembly includes a plurality of rollers, gears, and end caps. The rollers are in contact with each other to form a nip. Each roller includes a plurality of bearings. The gears include gear teeth. A respective gear has an involute tooth profile and applies a gear force at a pressure angle corresponding to the involute tooth profile to rotate at least one roller. The end caps are coupled to the bearings. At least one slot arranged to form a slot angle substantially equal to the pressure angle and to receive a respective bearing to support a respective roller.

15 Claims, 8 Drawing Sheets

BINARY INK DEVELOPER ASSEMBLY INCLUDING SLOTS HAVING A SLOT ANGLE CORRESPONDING TO A PRESSURE ANGLE

CROSS-REFERENCE TO REALTED APPLICATION

This application is a U.S. National Stage Application of and claims priority to International Patent Application No. PCT/US2014/058415, filed on Sep. 30,2014, and entitled "BINARY INK DEVELOPER ASSEMBLY INCLUDING SLOTHS HAVING A SLOT ANGEL CORRESPONDING TO A PRESSURE ANGLE," which is hereby incorporated by reference in its entirety.

BACKGROUND

Printing systems such as liquid electro photographic printers include binary ink developer assemblies to selectively form images on a photoconductive member. The binary ink developer assemblies include a plurality of rollers arranged in contact with respect to each other.

BRIEF DESCRIPTION OF THE DRAWINGS

For a detailed description of various examples, reference will now be made to the accompanying drawings in which.

DETAIL DESCRIPTION

Printing systems such as liquid electro photographic printers include binary ink developer (BID) assemblies to selectively form images on a photoconductive member. The BID assemblies include a plurality of rollers arranged in contact with respect to each other to form a nip with nip forces. Nip forces may be applied, for example, by a resilient member, and the like, pushing the respective rollers together. The rollers are typically driven by a motor through a drive assembly including a gear and/or gears to transmit a gear force. The profiles of gear teeth are typically defined by involute curves. The direction of the gear force is dependent on the pressure angle of the involute tooth profile of the gear and/or gears.

The gear force, for example, may include a tangential force component that transmits power to rotate at least one of the rollers. The gear force may also include a radial farce component. The radial force component, however, may force the gears to separate from each other. Such gear separation force may reduce a total amount of nip force. The reduction in nip force due to gear separation force may decrease its ability to maintain sufficient and/or uniform nip forces. The reduction and/or non-uniformity of nip forces may cause cleaning failures and print quality defects.

In some examples, a BID assembly includes rollers, a gear, a resilient member, and end caps. The rollers are in contact with each other to form a nip. Each roller includes bearings. The gear includes an involute tooth profile with a pressure angle. The gear also applies a gear force at the pressure angle corresponding to the pressure angle of the involute tooth profile to rotate at least one roller. A pressure angle is an angle between a gear force (e.g., tooth force) and a gear wheel tangent. That is, the pressure angle is an angle formed by a line tangent to a respective pitch circle, and a line normal to a respective involute tooth profile at the pitch circle. Thee resilient member forces the rollers against each other to produce nip forces at locations along a length of the nip, respectively. The end caps are coupled to the bearings, respectively, to support the corresponding rollers and include slots that constrain the bearings to linear motion.

Figure 1:
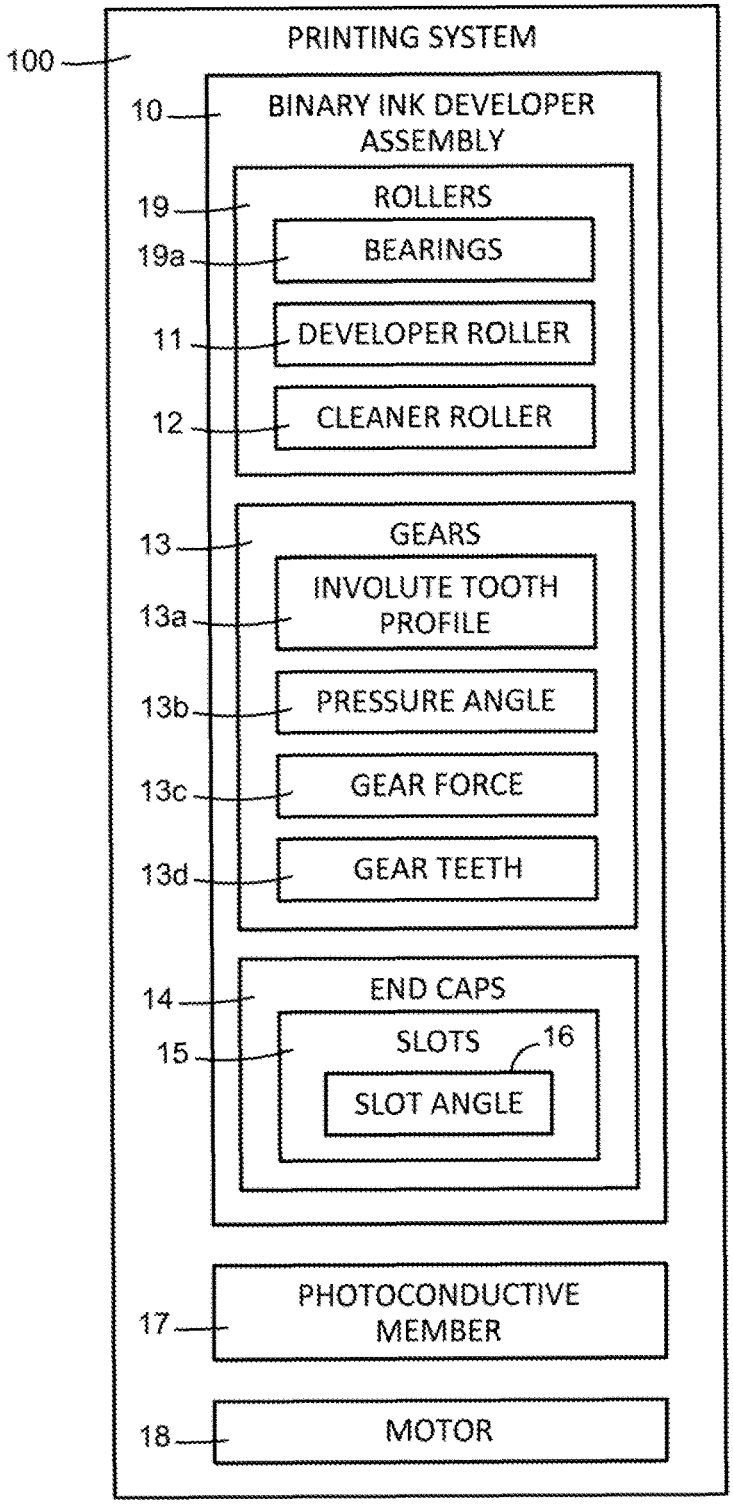
FIG. 1 is a block diagram illustrating a printing system according to an example.
Figure 3:
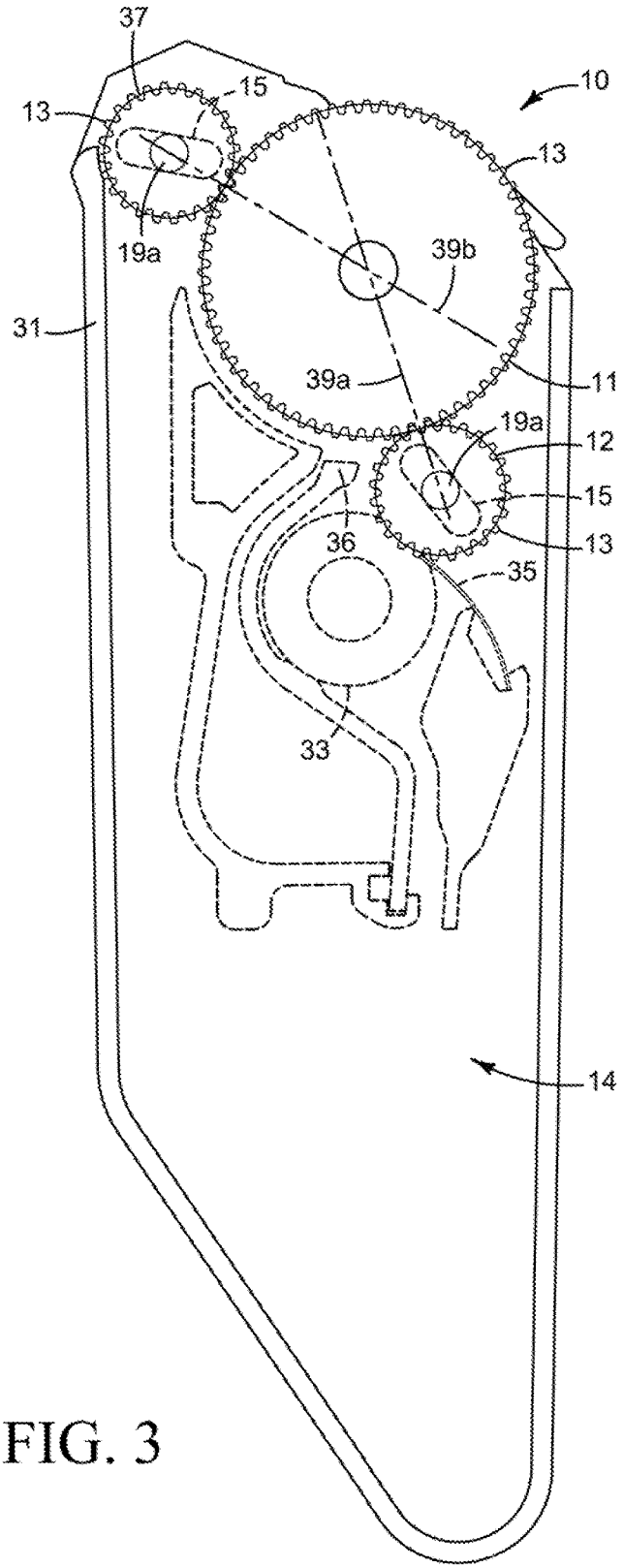
FIG. 3 is a schematic view illustrating a binary ink developer assembly of the printing system of FIG. 2 according to an example.

The slots are arranged to form a slot angle that is an angular offset from a center line between the two respective rollers and to receive a respective set of bearings to support one of the respective rollers, This slot angle may be an angle substantially equal to the pressure angle of the gear teeth. For example, the slot angle may form an angle with respect to the center line between the two respective rollers that is substantially equal to the pressure angle of the gear teeth (e.g., involute tooth profile). The slot having its slot angle substantially equal to the pressure angle enables the slot to fully support the gear force. That is, the gear force is directed substantially perpendicular to the slot to limit respective force components thereof from causing gear separation. Accordingly, eliminating gear separation forces may maintain sufficient and/or uniform nip forces. Consequently, cleaning failures and print quality defects may be reduced FIG. 1 is a block diagram illustrating a printing system according to an example. Referring to FIG. 1, a printing system 100 includes a binary ink developer (BID) assembly 10, a photoconductive member 17, and a motor 18. The BID assembly 10 includes a plurality of rollers 19 include bearings 19*a*, a plurality of gears 13, and a set of end caps 14, The plurality of rollers 19 including a developer roller 11, and a cleaner roller 12. In some examples, the rollers may also include a squeegee roller 37 (FIG. 3). The bearings 19*a* may be disposed on opposite ends of the corresponding rollers 19. The cleaner roller 12 is in contact with the developer roller 11 to form a nip there between and to clean the developer roller 11. The squeegee roller 37 is in contact with the developer roller 11 to form a nip there between to remove oil from the developer roller 11. For example, the developer roller 11, the cleaner roller 12, and the squeegee roller 37 may rotate with respect to each other.

Referring to FIG. 1, the motor 18 moves the gears 13. For example, the motor 18 may be coupled directly to the gear 13 or, indirectly, to the gears 13, That is, in some examples, a drive assembly including a plurality of gears 13 may be moved by the motor 18. The gears 13 include gear teeth 13*d* including an involute tooth profile 13*a* with a pressure angle 13*b*. Also, a respective gear 13 applies a gear force 13*c* at a pressure angle 13*b* corresponding to the involute tooth profile 13*a* to rotate at least one of the cleaner roller 12, the squeegee roller 37, and the developer roller 11. Each end cap 14 includes at least one respective slot 15 aligned to form a slot angle 16 that has an angular offset from the center line between the two respective rollers substantially equal to the pressure angle 13*b*. The respective slot 15 supports a respective bearing 19*a* corresponding to at least one of the cleaner roller 12 and the squeegee roller 37. The photoconductive member 17 engages the BID assembly 10 to form an image on the photoconductive member 17.

Figure 2:
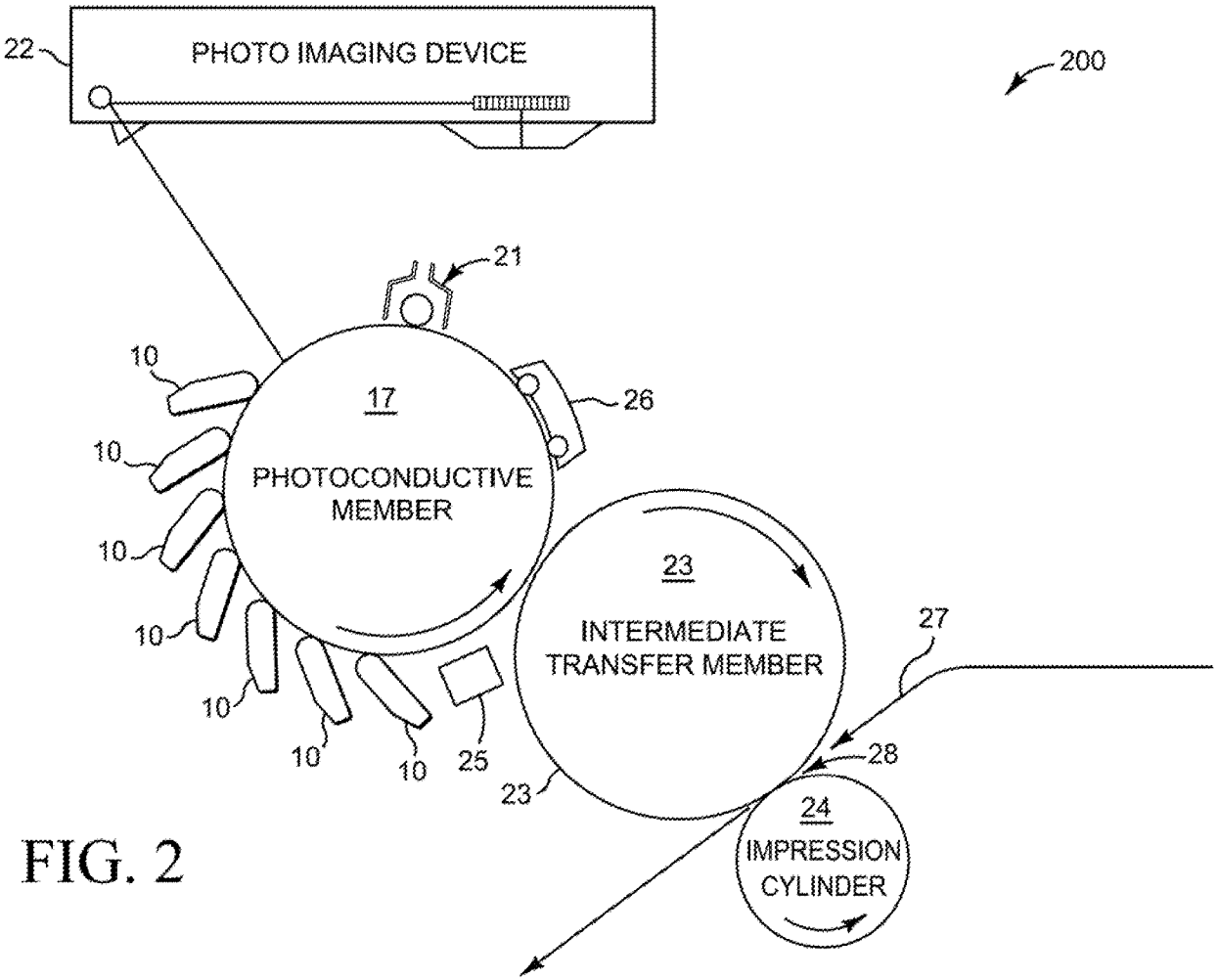
FIG. 2 is a schematic view illustrating a printing system according to an example.

FIG. 2 is a schematic view illustrating a printing system according to an example. Referring to FIG. 2, in some examples, a printing system 200 such as a liquid electro photographic (LEP) printer includes BID assemblies 10, a photoconductive member 17, a charging device 21, a photo imaging device 22, an intermediate transfer member (ITM) 23, an impression cylinder 24, a discharging device 25, and a cleaning station 26. The BID assemblies 10 are disposed adjacent to the photoconductive member 17 and may correspond to various colors such as cyan, magenta, yellow, black, and the like. The charging device 21 applies a uniform electrostatic charge to a photoconductive surface such as the outer surface of the photoconductive member 17 such as a photo imaging plate (PIP). A photo imaging device 22 such as a laser exposes selected areas on the photoconductive member 17 to light in a pattern of the desired printed image to dissipate the charge on the selected areas of photoconductive member 17 exposed to the light.

For example, the discharged areas on photoconductive member 17 form an electrostatic image which corresponds to the image to be printed. A thin layer of liquid toner is applied to the patterned photoconductive member 17 using the various BID assemblies 10 to form the latent image thereon. The liquid toner adheres to the discharged areas of photoconductive member 17 in a uniform layer of liquid toner on the photoconductive member 17 and develops the latent electrostatic image into a toner image. The toner image is transferred from the photoconductive member 17 to the ITM 23. Subsequently, the toner image is transferred from the ITM 23 to the print medium 27 as the print medium 27 passes through an impression nip 28 formed between the ITM 23 and the impression cylinder 24. The discharging device 25 removes residual charge from the photoconductive member 17. The cleaning station 28 removes toner residue in preparation of developing the next image or applying the next toner color plane.

FIG. 3 is a schematic view illustrating a binary ink developer assembly of the printing system of FIG. 2 according to an example. Referring to FIG. 3, in some examples, a BID assembly 10 includes a housing 31 including a set of end caps 14, a plurality of gears 13, a developer roller 11, a cleaner roller 12, a sponge roller 33, a wiper 35, a main electrode 36, and a squeegee roller 37. A potential bias between the main electrode 36 and the developer roller 11 initially transfers liquid toner to the developer roller 11.

Referring to FIG. 3, in some examples, the squeegee roller 37 regulates the liquid toner film thickness on the developer roller 11. Liquid toner is then selectively transferred from the developer roller 11 to the discharged portions of the surface of the photoconductive member 17 (FIG. 1), The cleaner roller 12 electrically removes remaining liquid toner from the developer roller 11. The wiper 35 cleans the cleaner roller 12. The sponge roller 33 cleans the wiper 35. In some examples, the wiper 35 or other resilient member may force the cleaner roller 12 and the developer roller 11 against each other to form a nip.

Referring to FIG. 3, in some examples, both ends of the developer roller 11 include a respective bearing 19*a*, The end caps 14 may be disposed on opposite sides of the housing 31. The end caps 14 include slots 15 that have an offset of angle $\alpha_s$ 16 from a center line 39*a* and 39*b* of two rollers. The slots 15 receive bearings 19*a* of corresponding rollers. The gear 13 applies a gear force 13*c* at a pressure angle 13*b* corresponding to a pressure angle of the involute gear tooth profile 13*a* to rotate at least one roller such as the cleaner roller 12, the squeegee roller 37, and/or the developer roller 11. In some examples, at least one slot corresponding to a respective end cap 14 includes a first slot and a second slot. The first slot receives a respective bearing corresponding to the cleaner roller 12. The second slot receives a respective bearing corresponding to the squeegee roller 37.

Figure 4:
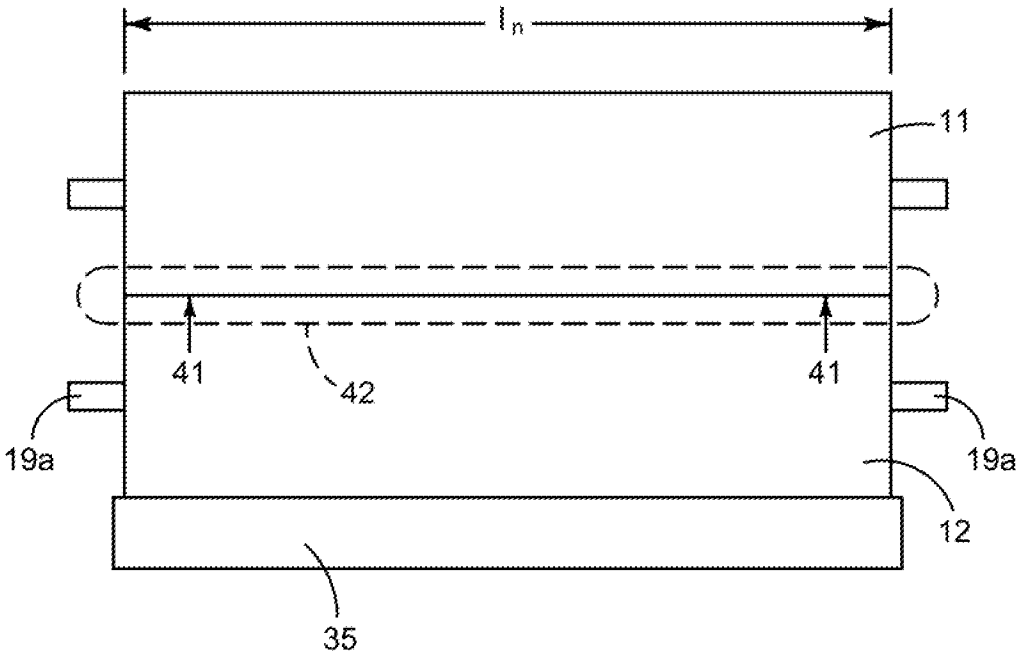
FIG. 4 is a schematic view illustrating several rollers and a wiper of the binary ink developer assembly of FIG. 3 to form a nip according to an example.

FIG. 4 is a schematic view illustrating several rollers and a wiper of the binary ink developer assembly of FIG. 3 to form a nip according to an example. Referring to FIG. 4, in some examples, a cleaner roller 12 is disposed between and in contact with a developer roller 11 and a wiper 35. For example, the cleaner roller 12 may rotate to clean the developer roller 12 and be cleaned by the wiper 35. The wiper 35 may also press the cleaner roller 12 against the developer roller 11 establishing nip forces 41 to form a nip 42 there between. For example, the nip forces 41 are established at locations along a length $I_n$ of the nip 42.

Figure 5A:
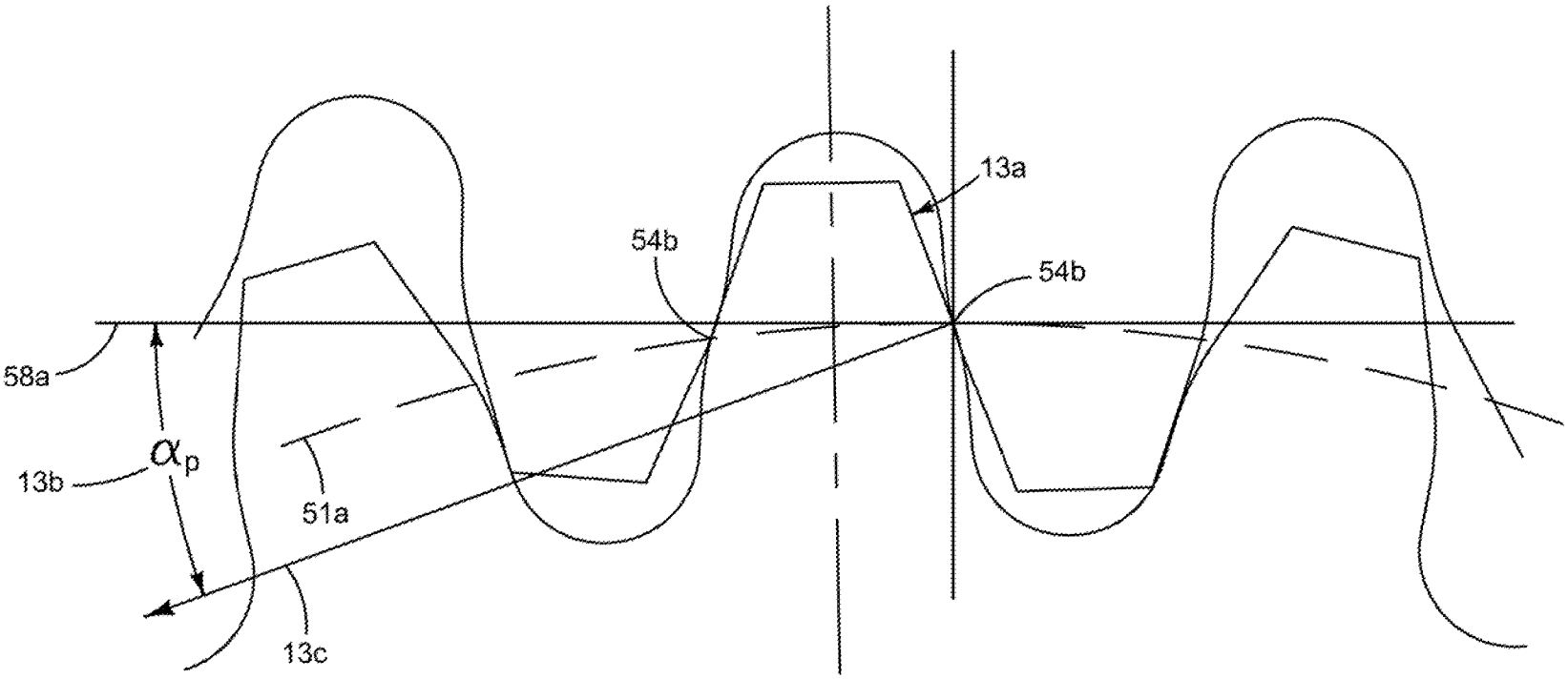
FIG. 5A is a detailed view of a gear portion of the binary ink developer assembly of FIG. 3 according to an example.
Figure 5B:
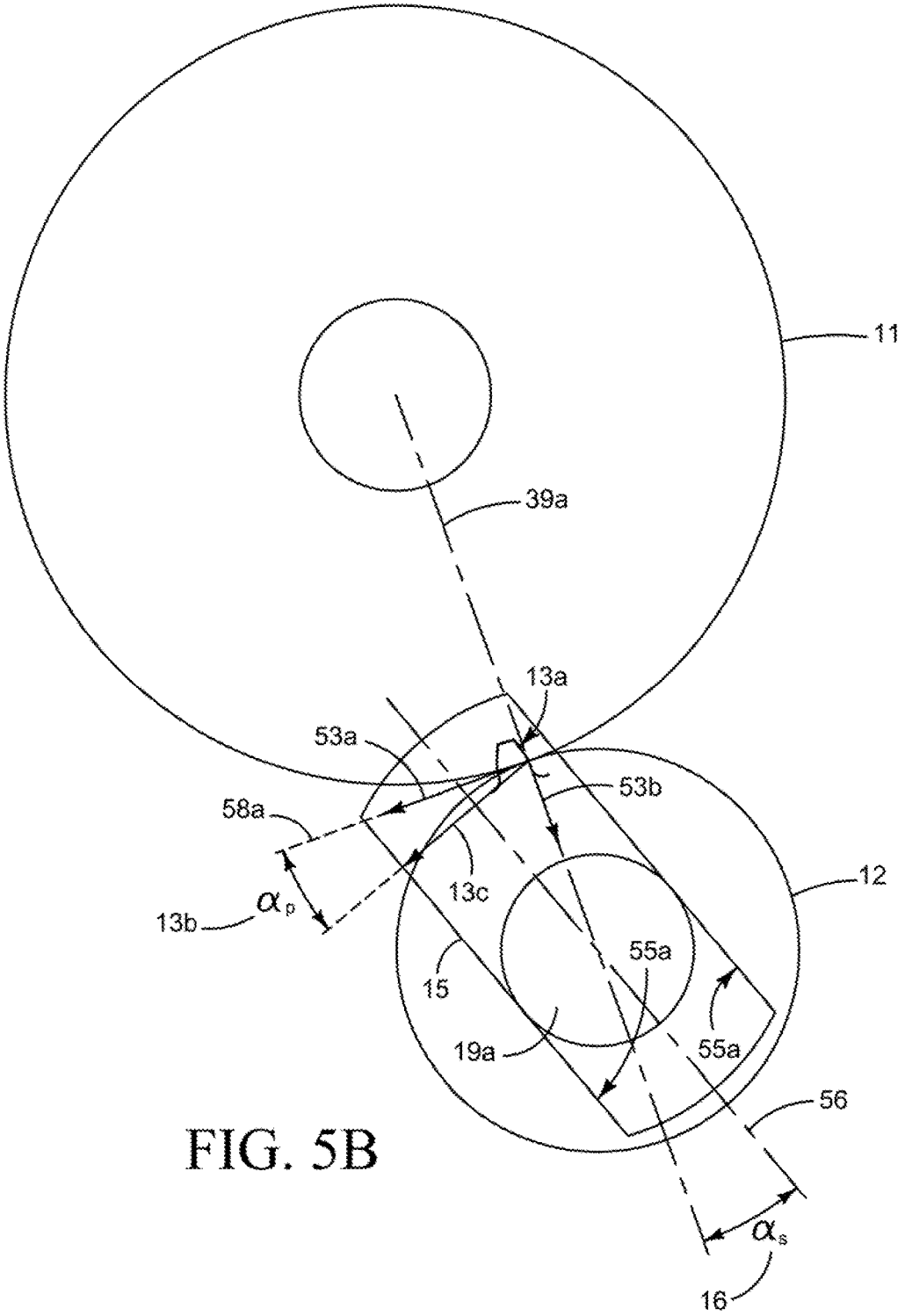
FIG. 5B is a schematic view of a slot of he binary ink developer assembly of FIG. 3 according to an example.

FIG, 5A is a detailed view of a gear portion of the binary ink developer assembly of FIG. 3 according to an example. FIG. 5B is a schematic view of a slot of the binary ink developer assembly of FIG. 3 according to an example. Referring to FIGS. 5A-5B, in some examples, a gear 13 includes an involute tooth profile 13*a* and a pitch circle 51*a*. The involute tooth profile 13*a* is a shape of a respective tooth of a gear 13 that forms a respective pressure angle $\alpha_p$ 13*b*. The pitch circle 51*a* is a circle passing through pitch points 54*b* of respective teeth of the gear 13. The direction of the gear force 13*c* provided by the gear 13 is dependent on the pressure angle $\alpha_p$ 13*b* of the involute tooth profile 13*a* thereof. The pressure angle $\alpha_p$ 13*b* is an angle formed by a tangent line 58*a* to a respective pitch circle 51*a*, and a normal line (e.g., gear force 13*c*) perpendicular to a respective involute tooth profile 13*a* at the pitch circle 51*a*.

The direction of the gear force 13*c* provided by the gear 13 is dependent on the pressure angle $\alpha_p$ 13*b* of the involute tooth profile 13*a* thereof. The gear force 13*c*, for example, may include a tangential force component 53*a* that transmits power to rotate at least one of the rollers. The gear force 13*c* may also include a radial force component 53*b*. In some examples, the radial force component 53*b* may be fully supported by the slot 15 to limit it from enabling gears to separate from each other and cause a reduction of nip forces 41 (FIG. 4). Accordingly, limitation of the radial force component 53*b* may reduce non-uniformity of nip forces 41, cleaning failures, and print quality defects.

Referring to FIGS. 5A-5B, in some examples, each end cap 14 includes a respective slot 15 aligned to form a slot angle 16. The slot angle 16 is a substantially equal to the pressure angle 13*b* and to support a respective bearing 19*a* corresponding to at least one of the cleaner roller 12 and the squeegee roller 37. In FIG. 5B, the bearing 19*a* may include a second gear (not shown) in a mesh arrangement with the gear 13 to rotate the cleaner roller 12. In some examples, a respective slot 15 of an end cap 14 includes wall surface portions 55*a* substantially parallel to each other and one of the wall surface portions 55*a* to receive the gear force 13*c* at an angle of substantially ninety degrees. Additionally, each slot 15 may form a linear path 56 for the respective bearing to travel substantially perpendicular to the gear force 13*c*.

The respective slot 15 may support a radial force component 53*b* in its entirety of the gear force 13*c* normal to the pressure angle $\alpha_p$ 13*b* generated by the gear 13. Further, a slot angle $\alpha_s$ 16 and a pressure angle $\alpha_p$ 13*b* are set substantially equal to each other to reduce gear separation forces and maintain the nip forces 41 at the locations along the length $I_n$ of the nip 42 uniform with respect to each other. For example, a nip force 41 at one end of a respective roller may be substantially equal to a nip force 41 at another end of the respective roller. In some examples, eliminating gear separation force 13*c* may maintain the nip forces 41 uniform along the length $I_n$ of the nip 42.

Figure 6:
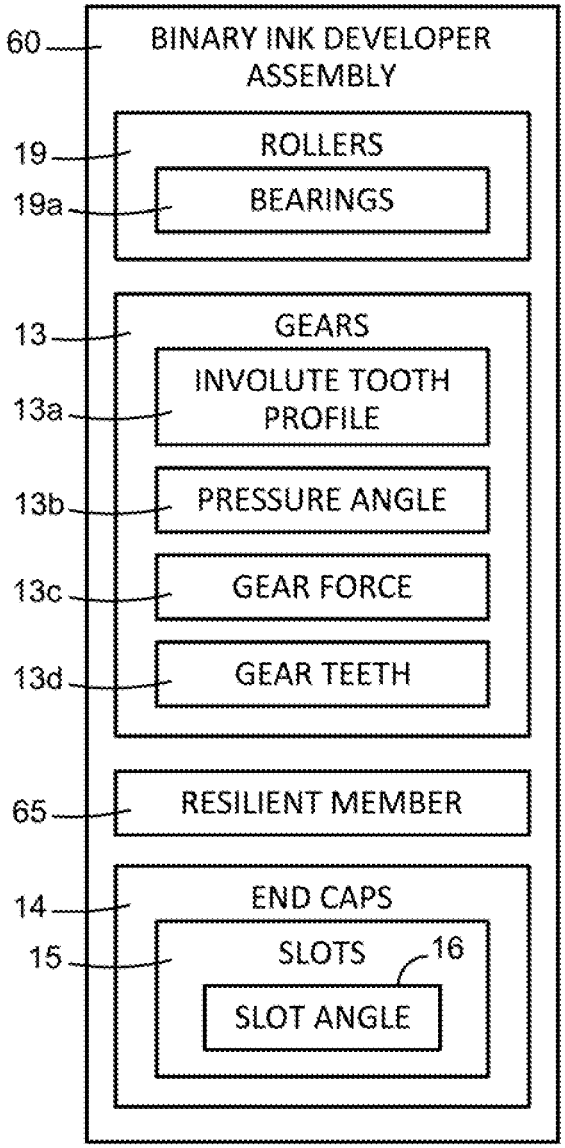
FIG. 6 is a block diagram illustrating a binary ink developer assembly according to an example.

FIG. 6 is a block diagram illustrating a binary ink developer assembly according to an example. The binary ink developer assembly 60 is usable with a printing system. In some examples, the binary ink developer assembly 60 may include the binary ink developer assembly 10 of the printing system 100 of FIGS. 1-5. Referring to FIG. 6, in some examples, the BID assembly 60 includes a plurality of rollers 19, gears 13, a resilient member 65, and a set of end caps 14. The rollers 19 are in contact with each other to form a nip. Each roller 19 includes a plurality of bearings 19*a*. The gears 13 include gear teeth 13*d*. The gears include an involute tooth profile 13*a* with a pressure angle 13*b*. The respective gear 13 applies a gear force 13*c* at a pressure angle 13*b* corresponding to the involute tooth profile 13*a* to rotate at least one roller. In some examples, the pressure angle 13*b* and the slot angle 16 are substantially twenty degrees.

Referring to FIG. 6, the resilient member 65 forces the plurality of rollers 19 against each other to produce a plurality of nip forces at a plurality of locations along a length of the nip, respectively. In some examples, the resilient member 65 contacts the respective roller. The end caps 14 couple to the bearings 19*a*, respectively. The end caps 14 support the rollers 19. At least one set of slots 15 are arranged to form a slot angle 16 substantially equal to the pressure angle 13*b* and to receive a respective set of bearings to support a respective roller. In some examples, the slots 15 are to maintain the nip forces at the locations along the length of the nip uniform with respect to each other. For example, a respective slot includes wall surface portions substantially parallel to each other in which one of the wall surface portions receives the gear force 13*c* at an angle of substantially ninety degrees.

Figure 7:
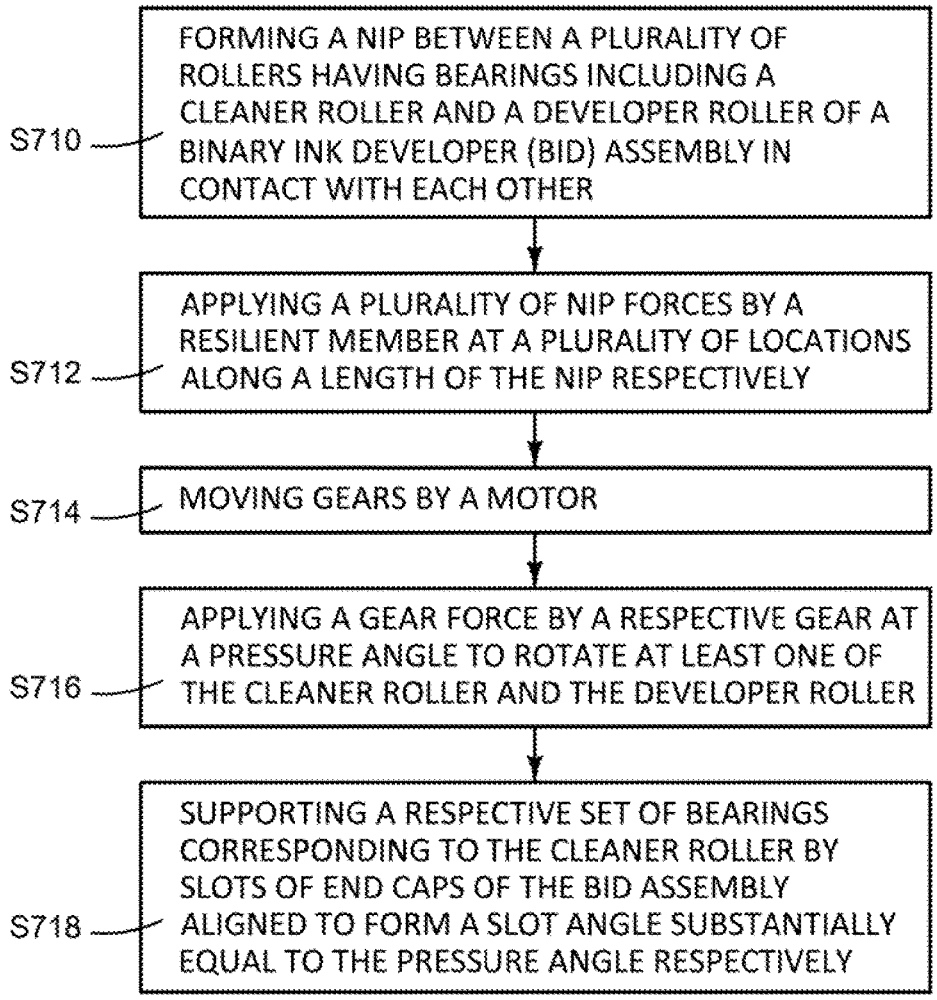
FIG. 7 is a flowchart illustrating a method of operating a binary ink developer assembly according to an example.

FIG. 7 is a flowchart illustrating a method of operating a binary ink developer assembly according to an example. In block S710, a nip is formed between a plurality of rollers having bearings including a cleaner roller and a developer roller of the BID assembly in contact with each other. In block S712, a plurality of nip forces is provided by a resilient member at a plurality of locations along a length of the nip, respectively. In block S714, gears are moved by a motor. In block S716, a gear force is applied by a respective gear at a pressure angle to rotate at least one of the cleaner roller and the developer roller. in block S718, a respective set of bearings corresponding to the cleaner roller is supported by slots of end caps of the BID assembly aligned to form a slot angle substantially equal to the pressure angle, respectively.

For example, a radial force component normal to the pressure angle generated by the gear may be supported in its entirety by a respective slot. In some examples, the method may also include forcing the cleaner roller and the developer roller against each other by a resilient member of the BID assembly to produce a plurality of nip forces at a plurality of locations along a length of the nip, respectively. The method may also include maintaining the nip forces at the locations along the length of the nip uniform with respect to each other.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A binary ink developer assembly usable with a printing system, the binary ink developer assembly comprising:

a plurality of rollers in contact with each other to form a nip, each roller including a plurality of bearings;

a plurality of gears including gear teeth, a respective gear including an involute tooth profile and to apply a gear force at a pressure angle corresponding to the involute tooth profile to rotate at least one roller; and a resilient member to force the plurality of rollers against each other to produce a plurality of nip forces at a plurality of locations along a length of the nip, respectively; and a plurality of end caps coupled to the bearings, respectively, to support the plurality of rollers, at least one set of slots arranged to form a slot angle substantially equal to the pressure angle and to receive a respective set of bearings to support a respective roller.

2. The binary ink developer assembly of claim 1, wherein the set of slots is to maintain the nip forces at the locations along the length of the nip uniform with respect to each other.

3. The binary ink developer assembly of claim 1, wherein the resilient member is to contact the respective roller.

4. The binary ink developer assembly of claim 1, wherein the pressure angle and the slot angle are substantially twenty degrees.

5. The binary ink developer assembly of claim 1, wherein each slot includes wall surface portions substantially parallel to each other, one of the wall portions to receive the gear force at an angle of substantially ninety degrees.

6. The binary ink developer assembly of claim 1, wherein the plurality of rollers includes a developer roller, a cleaner roller to clean the developer roller, and a squeegee roller to regulate a film thickness on the developer roller.

7. A printing system, comprising:

a binary ink developer assembly including a plurality of rollers including bearings, the rollers including a developer roller and a cleaner roller in contact with the developer roller to form a nip there between and to clean the developer roller;

a plurality of gears including gear teeth, a respective gear having an involute tooth profile and to apply a gear force at a pressure angle corresponding to the involute tooth profile to rotate at least one of the developer roller and the cleaner roller; and a set of end caps, each end cap including at least one slot aligned to form a slot angle substantially equal to the pressure angle and to support a respective bearing corresponding to the cleaner roller; and a photoconductive member to engage the binary ink developer assembly to form an image on the photoconductive member; and a motor to move the gears.

8. The printing system of claim 7, wherein the respective slot is to support a radial force component in its entirety of the gear force normal to the pressure angle generated by the respective gear.

9. The printing system of claim 7, wherein each slot is to form a linear path for the respective bearing to travel substantially perpendicular to the gear force.

10. The printing system of claim 7, wherein the plurality of rollers include a squeegee roller to regulate a film thickness on the developer roller.

11. The printing system of claim 10, wherein the at least one slot corresponding to a respective end cap includes:

a first slot to receive a respective bearing corresponding to the cleaner roller; and a second slot to receive a respective bearing corresponding to the squeegee roller.

12. The printing system of claim 7, further comprising:

a resilient member to force the developer roller and the cleaner roller against each other to produce a plurality of nip forces at a plurality of locations along a length of the nip, respectively.

13. A method of operating a binary ink developer (BID) assembly, the BID assembly comprising:

forming a nip between a plurality of rollers having bearings including a cleaner roller and a developer roller of the BID assembly in contact with each other;

applying a plurality of nip forces by a resilient member at a plurality of locations along a length of the nip, respectively;

moving gears by a motor;

applying a gear force by a respective gear at a pressure angle to rotate at least one of the cleaner roller and the developer roller; and supporting a respective set of bearings corresponding to the cleaner roller by slots of end caps of the BID assembly aligned to form a slot angle substantially equal to the pressure angle, respectively.

14. The method of claim 13, further comprising:

forcing the cleaner roller and the developer roller against each other by a resilient member of the BID assembly to produce a plurality of nip forces at a plurality of locations along a length of the nip, respectively; and maintaining the nip forces at the locations along the length of the nip uniform with respect to each other.

15. The method of claim 13, wherein the supporting a respective set of bearings corresponding to at least one of the cleaner roller and the squeegee roller by slots of end caps of the BID assembly aligned to form a slot angle substantially equal to the pressure angle further comprises:

supporting a radial force component in its entirety normal to the pressure angle generated by the gear by a respective slot.

* * * * *